US007836529B2

(12) United States Patent
Cherubini et al.

(10) Patent No.: US 7,836,529 B2
(45) Date of Patent: Nov. 23, 2010

(54) METHOD AND APPARATUS FOR DETECTING THE PRESENCE OR ABSENCE OF A PERSON ON A FLEXIBLE SUPPORT

(75) Inventors: Julian H. Cherubini, Boston, MA (US); Jesse Drake, Clinton, MA (US)

(73) Assignee: AliMed, Inc., Dedham, MA (US)

( * ) Notice: Subject to any disclaimer, the term of this patent is extended or adjusted under 35 U.S.C. 154(b) by 268 days.

(21) Appl. No.: 12/070,084

(22) Filed: Feb. 15, 2008

(65) Prior Publication Data

US 2008/0136226 A1 Jun. 12, 2008

Related U.S. Application Data

(62) Division of application No. 11/126,906, filed on May 11, 2005, now Pat. No. 7,331,071.

(51) Int. Cl.
*A47C 31/00* (2006.01)
*G08B 21/22* (2006.01)

(52) U.S. Cl. ..... 5/83.1; 5/89.1; 5/652; 5/940; 340/573.1; 340/665; 340/666

(58) Field of Classification Search ..... 5/653, 5/652, 940, 658, 83.1, 612, 85.1, 89.1, 625–628, 5/904, 905; 340/573.1, 665–668
See application file for complete search history.

(56) References Cited

U.S. PATENT DOCUMENTS 3,903,513 A 9/1975 Green et al.
4,712,834 A 12/1987 Warrick
6,025,782 A 2/2000 Newham
6,297,738 B1 10/2001 Newham
6,778,090 B2 8/2004 Newham
6,963,286 B2 11/2005 Marquis et al.
7,178,870 B2 2/2007 Wolfe et al.
7,331,071 B1 2/2008 Cherubini et al.

(Continued)

*Primary Examiner*—Robert G Santos
(74) *Attorney, Agent, or Firm*—Wolf, Greenfield & Sacks, P.C.

(57) ABSTRACT

A method and apparatus is disclosed for sensing when a person is disposed on or arises from a support that flexes or sags when a person is disposed thereon. Such supports include beds, supports for a mattress or a seat, such as a sling-type seat found on wheelchairs. In one embodiment, an assembly is positioned beneath the support and includes a sensor. The sensor indicates when tension on the assembly exceeds a certain amount which is indicative of sagging of the support. The assembly may be adjustable in length to maintain proper tension in the absence of sag. The sensor may be a switch that includes a plunger which operates against the bias of a biasing member which either completes or interrupts an electrical circuit in response to tension placed on the assembly due to sagging of the support. In another embodiment, the assembly may be at least partially elastic. In yet another embodiment, a strain gauge may be employed to detect stretching of the assembly due to sagging of the support. In the method of the invention, a signal received from the sensor may be employed either with or without a processor to activate an alarm or to activate a light or to activate another audible signal or to send a signal over a telephone line. In addition, the signal received may be used to activate or deactivate a brake on a wheelchair.

17 Claims, 4 Drawing Sheets

U.S. PATENT DOCUMENTS

2002/0070866 A1 6/2002 Newham
2005/0190068 A1 9/2005 Gentry et al.
2008/0136226 A1* 6/2008 Cherubini et al. ..... 297/217.2

* cited by examiner

METHOD AND APPARATUS FOR DETECTING THE PRESENCE OR ABSENCE OF A PERSON ON A FLEXIBLE SUPPORT

BACKGROUND OF INVENTION

1. Field of Invention

This invention relates generally to a method and apparatus for detecting the presence or absence of a person on a flexible support, and more particularly, to a mechanism and method to be used with a sling-type seat using an expandable strap.

2. Discussion of Related Art

It is desirable to be able to monitor when a person is either present on or is not present on a flexible support, such as a seat or a bed. A typical example of such a seat is a sling-type of seat which typically includes a fabric seat portion which extends between at least two generally parallel, rigid support members. The fabric is flexible and provides a degree of comfort to the person seated, yet must be sufficiently strong so that it can support the weight of such a person. The seat may be made of any suitable fabric, such as canvass, cotton, nylon, Kevlar or the like. Chairs are typically provided with a sling-type of seat to allow for folding of the chair for storage or transport. One typical example of a chair with a sling-type of seat is a wheelchair.

Because of its non-rigid nature, the seat of a sling-type of seat will sag in the middle. When a person is seated on the seat, the seat, regardless of the material from which it is formed, will stretch slightly, producing a greater sag. The seat will demonstrate some level of sag even when no one is seated therein. With time, the fabric of the sling-type seat will tend to take on a permanent stretch and sag after repeated use. This is commonly termed "sling seat sag". With respect to a wheelchair, some of this additional sag is due to side supports being pulled toward one another by the weight of the body and part of the sag is due to whatever inherent stretchability is found in the fabric. As this sag increases, the spacing of the bottom of the seat from a horizontal line drawn between the two side supports also increases, and the actual length of the fabric material of the seat is necessarily longer than a straight, generally horizontal line drawn between the two support members.

When a person arises from such a sling-type of seat, the inherent elasticity in the material of the seat will cause the seat to return ever so slightly toward its pre-stretched length. In addition, the side support rails may return to a wider spacing which is maintained by any support structure and braces.

It would be desirable to be able to determine when someone becomes seated in a sling-type seat, particularly a wheelchair. It would also be desirable to determine when someone arises from a sling-type seat, such as a wheelchair. This information could be used to monitor movement of a patient for various purposes.

Currently there exist compression switches that are used in conjunction with wheelchairs and that are activated when a person is seated in a wheelchair. These compression switches, however, are attached to the side rails by an inelastic or rigid member. These types of switches are undesirable because they cause unnecessary pressure from beneath the seat on the person seated therein. This rigid or non-elastic member not only is uncomfortable for a seated person, but causes excessive pressure which could lead to skin breakdown and, after continuous or substantially extended use, a decubitus ulcer.

SUMMARY OF INVENTION

This invention relates generally to a method and apparatus for detecting the presence or absence of a person on a flexible support, including a seat, a bed, a support for a mattress or the like. This invention provides a signal indicative of either the presence or absence of a person on the support to alert a caregiver or some other person. Any sort of response may be provided, such as an audible signal (i.e., an alarm), a visual signal, a recorded telephone message, or a signal over a telephone line. A signal may also be used to either apply or release brakes on a wheelchair. This invention has particular applicability to seats which sag when a person is seated therein, such as the seat of a wheelchair. However, the application of this invention is not limited to wheelchair seats, or even to chairs. It could also be used to detect when a person is lying in a bed or is seated on the edge of a bed. This invention overcomes the problems associated with prior art devices which typically are not flexible, or are not elastic, or both, and which render the support, such as a seat, uncomfortable and could even, in extreme cases, cause injury to the person.

In one aspect, a combination of a support for a person and a sensor is disclosed. In one embodiment of this aspect, this combination includes a flexible support having an upper surface upon which a person may be disposed and a lower surface, and a flexible assembly which is secured adjacent the lower surface of the support, the assembly including a sensor that provides an electrical signal which is indicative of the presence or absence of a person on the upper surface of the support and which is produced by tension on the assembly resulting from downward flexing of the support. This combination may include a strap, and this strap may comprise at least one elastic portion. This elastic portion may include a spring. In another embodiment, the assembly may be fixedly attached to two side rails.

In another embodiment of this aspect, the sensor comprises a housing, a plunger slidable with respect to the housing, a member biasing the plunger into a first axial position with respect to the housing, a pair of spaced contacts disposed in the housing, and a conductor associated with the plunger for providing an electrical connection between the spaced contacts. In this embodiment, the plunger may be axially slidable from a first axial position to a second axial position upon the application of tension to the assembly resulting from downward flexing of the seat. In another embodiment, the conductor is spaced from the electrical contacts in the first axial position, and is in electrical contact with both of the electrical contacts in the second axial position. In yet another embodiment, the conductor is in electrical contact with both of the electrical contacts in the first axial position, and is spaced from the electrical contacts in a second axial position.

In yet another embodiment of this aspect, the combination includes a processor configured to receive an electrical signal from the electrical contacts. This processor may be selectively coupled to an alarm, an audible signal device, a light, a telephone jack or a brake associated with a chair.

In yet another embodiment of this aspect, at least a portion of the assembly is elastic, and the sensor comprises a strain gauge coupled to the elastic portion of the assembly.

In another aspect of the invention, a system is disclosed for providing an indication of the presence or absence of a person on a support which flexes downwardly when a person is disposed thereon. This system comprises a strap structured to be disposed adjacent a lower surface of the support and is fixed to prevent movement thereof with respect to the support, the strap including an elastic portion. The system also includes a sensor associated with the strap for providing an indication of when downward flexing of the support caused by a person disposed on the support exceeds a predetermined amount or is less than a predetermined amount. In one embodiment, the support is a seat.

In yet another aspect of the invention, a method is disclosed for determining whether a person is disposed on a support that flexes downwardly when a person is disposed thereon. This method comprises the steps of affixing an assembly with respect to the support beneath the support adjacent a lower surface thereof, adjusting a length of the assembly so that the assembly generally conforms to the shape of the lower surface of the support when no one is disposed on the support, and providing an electrical signal from a sensor associated with the assembly indicative of when tension on the assembly exceeds a predetermined amount resulting from flexing of the support downwardly when a person is disposed thereon. In one embodiment of this aspect, the method includes the further step of activating an alarm in response to the signal. In another embodiment of this aspect, the method includes the step of activating an alarm in the absence of a signal.

In yet another embodiment of this aspect, the method further includes the step of sending a signal to a processor. In another embodiment, the method includes the step of activating a light in response to the signal or in the absence of the signal. In another embodiment, the method includes manipulating a brake associated with a seat in response to the signal. In yet another embodiment, the method further includes sending a signal over a telephone line in response to the signal received from the sensor. In yet another embodiment, the method includes the step of providing an elastic portion on the assembly. In yet another embodiment, the method includes providing another electrical signal from the sensor indicative of tension on the assembly below a certain amount.

BRIEF DESCRIPTION OF DRAWINGS

The objects, advantages and features of this invention will be more clearly appreciated from the following detailed description, when taken in conjunction with the accompanying drawings, in which.

DETAILED DESCRIPTION

This invention relates to a sensor assembly for use with a flexible support. Examples of a support with which this invention may be used include a seat, a bed or a support for a mattress or the like. This invention is particularly suited for use with a sling-type seat, to provide an indication of when a person is seated in that seat, and/or when a person has left that seat. A typical sling-type seat is found on a wheelchair. In one aspect, the sensor assembly preferably is disposed beneath but closely spaced from the support, and is activated as a result of the stretching and resultant sagging of the material of the support when a person is disposed thereon, or by the absence of stretching and sagging of the material when the person leaves the support. The sensor assembly typically is capable of stretching and/or expanding to accommodate stretching and/or sagging of the support material caused by the presence of a person thereon.

The sensor assembly typically includes a strap and a sensor. The sensor used in conjunction with this invention may be any type of device which senses flexing or stretching of the support as a result of a person being present. In one embodiment, the sensor is a switch which is biased into an open position and is closed when a person is disposed on the support. In another embodiment, the switch is biased into a closed position, and is opened by a person being on the support. In either embodiment the switch may include a plunger which is biased into one portion and slides against the bias into another position in response to stretching and/or sagging of the support to accommodate such stretching and/or sagging. In yet another embodiment, the sensor is a strain gauge calibrated for the degree of stretching of the support material expected to occur when a person is present thereon.

In any embodiment, a resulting signal may be sent to a processor which provides an indication that a person is present on the support, or that a person has left the support. The signal may be used in a variety of ways, such as sending an alarm, activating a visual alarm, placing a call for assistance, or activating or releasing a braking mechanism for a wheelchair.

In another aspect of the invention, the sensor assembly may include an elastic component which accommodates stretching or flexing or sagging of the support after the switch is opened or closed to prevent damage to the switch and to minimize upward forces on the support and the user of the support.

Figure 1:
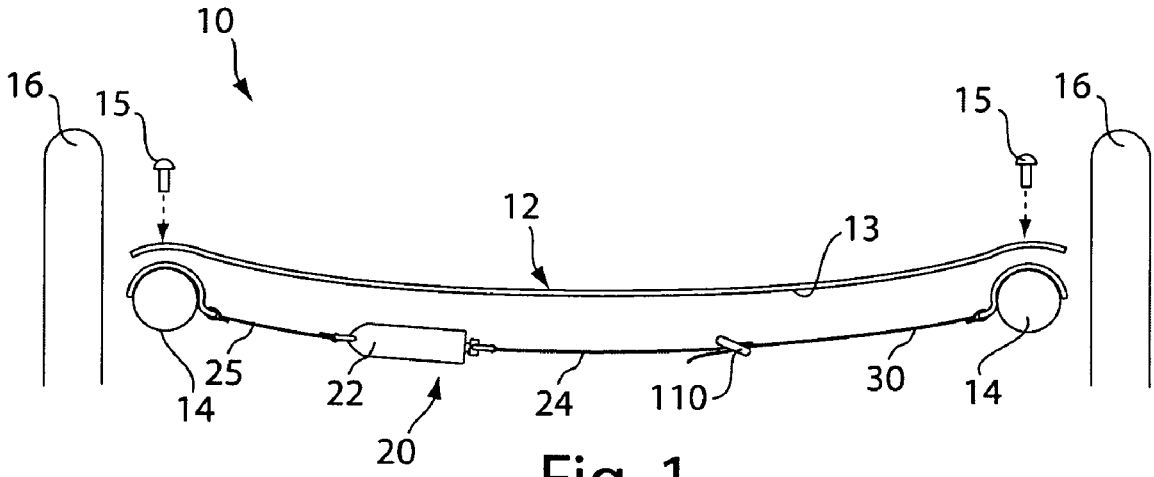
FIG. 1 is a side schematic view illustrating the sensor of the present invention installed on an empty support, such as a seat.
Figure 2:
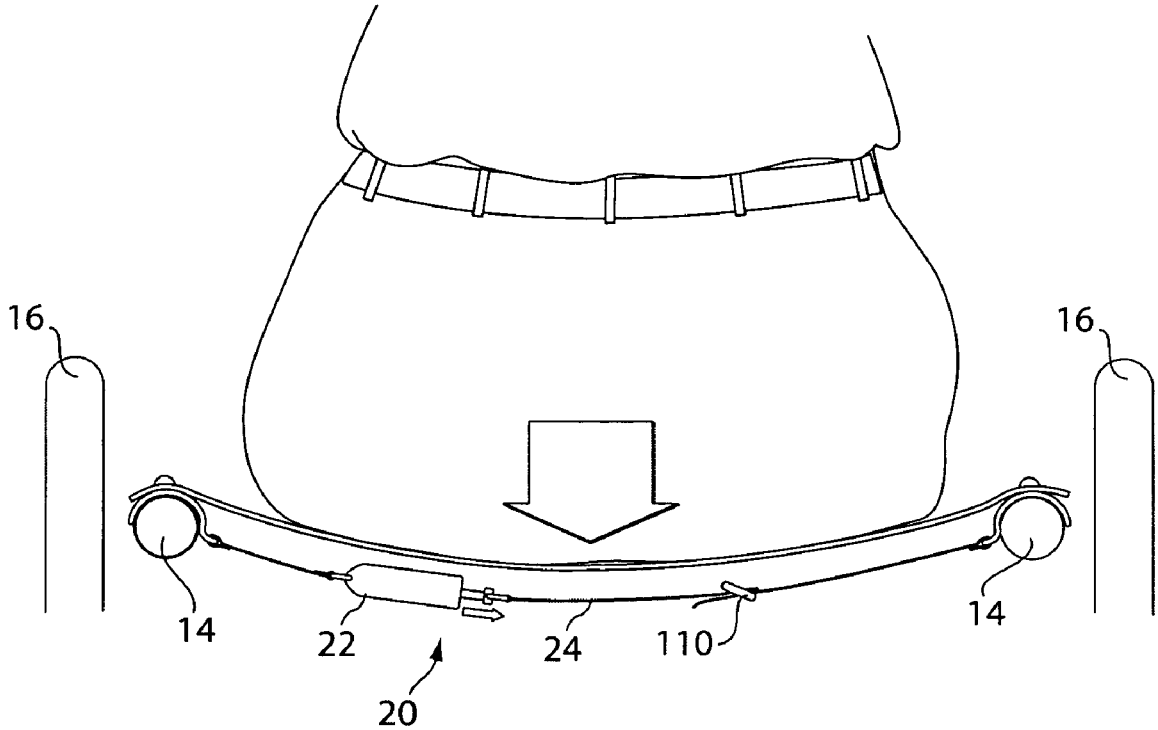
FIG. 2 is a side schematic view of the support and sensor of FIG. 1 illustrating the effect of a person being seated thereon.

With reference now to the drawings, and more particularly to FIGS. 1 and 2 thereof, one aspect of this invention will be described. Sensor assembly 20 will now be described with respect to one embodiment of the support of this invention, a chair 10 with a seat 12. However, it is to be understood that the operation and structure of sensor assembly 20 when used with another embodiment of the support of this invention, such as a bed or a support for a mattress, are substantially the same as that described with respect to chair 10 and seat 12. It is to be understood, of course, that seat 12 could represent a bed or a support layer for a mattress upon which a person could sit or lie.

FIG. 1 is a schematic illustration of a chair 10 with a flexible seat 12, such as a sling-type seat. Seat 12 may be suspended between two side rails 14. Rails 14 are typically, but not necessarily, parallel and are mounted to a support structure (not shown) of chair 10. This support structure of chair 10 typically includes side supports 16. One example of a typical chair 10 is a wheelchair. In a wheelchair, wheels are typically mounted on the lower end of side supports 16. These wheels may include a braking system or the like 130 (see FIG. 9). Since seat 12 is flexible, side support 16 and rails 14 may be collapsed toward one another to fold chair 10 into a condition which allows it to be either stored or transported. Seat 12 may be attached to rails 14 in any manner well-known to those skilled in the art, such as by wrapping a portion of seat 12 about rails 14 and affixing seat 12 to rails 14 such as by screws, rivets or the like 15, as shown in FIG. 2.

Seat 12 may be formed of any material commonly known to be used with respect to flexible seats, such as sling-type seats. Typical materials for seat 12 include canvass, cotton, nylon, foam or the like. Regardless of the material used, because it is flexible and unsupported at its center, seat 12 is subject to a certain amount of deformation and stretching when a person sits on seat 12.

Sensor assembly 20 is disposed directly below seat 12 typically closely adjacent a lower surface 13 of seat 12. Sensor assembly typically conforms to the shape of lower surface 13 of seat 12. Sensor assembly 20 senses the sagging and/or flexing and/or deformation and/or stretching of seat 12 that occurs when someone sits on seat 12. Sensor assembly 20 preferably is flexible so as to allow it to be folded with seat 12 when chair 10 is collapsed. Sensor mechanism 20 typically also is sufficiently stretchable or expandable to permit it to accommodate the sagging and/or deformation and/or flexing and/or stretching of seat 12 in a manner so as to not exert any substantial upward force on seat 12 and a person seated therein. As a result, no discomfort is produced with respect to the person, and there is no concern that the person will in some way be injured by sensor assembly 20.

In one embodiment, sensor assembly 20 includes a sensor 22 and a flexible strap 24. Assembly 20 may also include an affixation device 26 disposed at or near each end of strap 24 to affix strap 24 to opposed rails 14, or other portions of the support structure for chair 10.

Affixation device 26 may be any type of connector which fixedly attaches strap 24 to rails 14 or to some other portion of the support structure for chair 10. Affixation device 26 typically is a connector which will not stretch, bend or otherwise deform under the weight of a person sitting on seat 12. In one embodiment, affixation device 26 may be a metal hook which is secured to rails 14. In another embodiment, affixation device 26 may be a screw, rivet or the like which secures strap 24 to rails 14 directly beneath seat 12. In this embodiment, devices 26 may be the same fastening mechanisms 15 used to secure the edges of seat 12 to rails 14.

As shown in FIG. 2, when a person sits on seat 12, it tends to flex under the weight of the person. A sag may be produced which is accompanied by a slight stretching of seat 12. This flexing, deformation and/or stretching results in a downward force on sensor assembly 20. Since each end of strap 24 is anchored, the downward force applied by the body of a person necessarily applies a tension or longitudinal force on assembly 20 which is directed along the length of assembly 20. It is this tension that is sensed by sensor 22.

Sensor 22 may be any type of device which will respond to the longitudinal tension or force applied parallel to the length of sensor assembly 20 which results from sagging, flexing, deformation and/or stretching of seat 12 caused by a downward force on seat 12 produced by a person sitting on seat 12.

Figure 3:
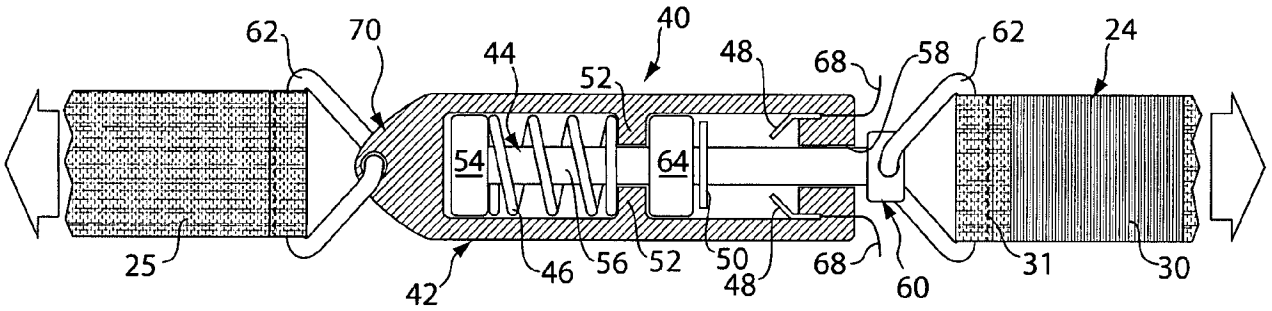
FIG. 3 is a partial, cross-sectional side view of one embodiment of the sensor assembly of this invention.

One example of a suitable sensor 22 is a switch. One embodiment of a suitable switch 40 is illustrated in FIG. 3. Switch 40 may include an outer housing 42, a plunger 44 having a shaft 56, a biasing member 46, contacts 48 and a conductor 50.

Shaft 56 of plunger 44 extends past lips 52 which typically surround shaft 56 on the interior of housing 42. End 60 of shaft 56 extends through opening 58 in one end of housing 42. Plunger 44 includes a head 54 on an end opposite end 60. Disposed on shaft 56 generally between head 54 and end 60 is an enlarged portion 64 which together with lips 52, limits movement of shaft 56 to the left as shown in FIG. 3, or toward head 54 and away from contacts 48, thereby limiting the extent to which plunger 44 can move away from contacts 48. Conductor 50 is mounted on shaft 56 on a side of enlarged portion 64 facing contacts 48. Conductor 50 may be a ring encircling shaft 56 and may be formed of any electrically conductive material. Contacts 48 extend into the interior housing 42 such that they face and may be contacted by conductor 50, but such that conductor 50 is spaced from contacts 48 in the normal, open position of switch 40, as shown in FIG. 3. Wires 68 extend externally of housing 42 from contacts 48.

Plunger 44 is slidable in a longitudinal or axial direction parallel to shaft 56 within and with respect to housing 42, typically in a direction generally parallel to the tension or longitudinal force applied to sensor assembly 20. Biasing member 46 typically is a compression spring, although member 46 could be any elastomeric member which is compressible, and which is sufficiently elastic to substantially return to its normal, uncompressed condition upon the release of a force. Biasing member 46 is positioned between and bears against lips 52 formed on the interior of housing 42, and enlarged head 54 formed on shaft 56. In this way, as illustrated in FIG. 3, plunger 44 is normally urged by biasing member 46 in a leftward direction as shown in FIG. 3, or in a direction in which conductor 50 is spaced from contacts 48 in the longitudinal direction.

In another aspect of the invention, sensor assembly 20 may also include an elastic component which will accommodate additional stretching of seat 12 beyond that which is necessary to activate sensor 22. In one embodiment, as shown in FIG. 3, this elastic component may be an elastic portion 30 of strap 24. Elastic portion 30 may comprise all or part of strap 24, or may compromise a plurality of separated segments of strap 24. Elastic portion 30 may be an elastic webbing, an extension spring or the like. If it is an elastic webbing, portion 30 may be any commonly available knitted or woven elastic which is sufficiently strong to withstand the forces applied, and to provide the desired level of elasticity to accommodate any additional stretching of seat 12 beyond that accommodated by switch 40. The purpose of elastic portion 30 includes prevention of damage to switch 40, and prevention of sensor assembly 20 from becoming undesirably tight beneath seat 12 to avoid discomfort and injury to the person seated in the seat caused by an upward force on the seat. In this embodiment, the spring constant of biasing member 46 of switch 40 typically is lower than the spring constant of portion 30, so that biasing member 46 will be compressed to the point where conductor 50 touches contacts 48 before the elastic portion 30 stretches significantly. In this way, the switch will always be closed before substantial stretching of elastic portion 30 occurs, and stretching of portion 30 will not override or thwart the operation of switch 40.

As shown in FIG. 3, in one embodiment, elastic portion 30 is affixed to end 60 of plunger 44 by a non-elastic connector 62. Elastic portion 30 may be affixed to connector 62 in any manner known to one of ordinary skill in the art. In one example, as illustrated in FIG. 3, an end piece of elastic portion 30 is folded over connector 62 and onto itself and is sewn to itself by stitch 31. Portion 25 of strap 24 may be affixed to end 70 of housing 42 by another connector 62 in the same manner. Portion 25 typically is non-elastic. However, portion 25 may also be elastic in another embodiment of the invention. Of course, the positions of portions 30 and 25 may be reversed so that portion 30 is affixed to end 70 and portion 25 is affixed to end 60. Connector 62 may be any commonly used device, such as a metal bracket or the like, having any shape desired, such as triangular, square, rectangular or the like. In addition, instead of using a connector 62, portion 25 and elastic portion 30 may be affixed directly to respective end 70 and end 60 such as by screws, rivets, adhesives or the like.

The operation of the embodiment of sensor assembly 20 illustrated in FIG. 3 will now be described with particular reference to FIGS. 3, 4 and 5. FIG. 3 illustrates the condition of switch 40 when seat 12 is in the condition shown in FIG. 1, in which no one is seated. In FIG. 3, biasing member 46 urges plunger 44 to the left, as shown in FIG. 3, or in a direction such that conductor 50 is spaced from contacts 48. Typically, although not necessarily, enlarged portion 64 may be urged into engagement with lips 52. The switch is in an open condition as there is no contact between conductor 50 and contacts 48. Elastic portion 30 is in a substantially unstretched or relaxed condition.

Figure 4:
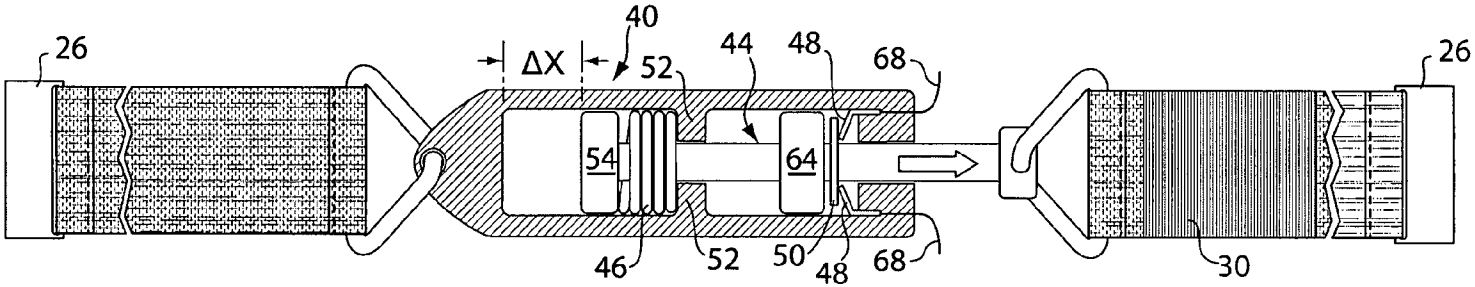
FIG. 4 is a partial, cross-sectional side view of the sensor assembly of FIG. 3 in a switched condition.

FIG. 4 illustrates the condition of switch 40 when a person first begins to sit on seat 12, as illustrated in FIG. 2. As shown in FIG. 4, plunger 44 is urged to the right, or in a direction which moves conductor 50 toward contacts 48. This movement results from the initial downward force exerted on seat 12 by the weight of the occupant of seat 12. This downward force flexes, deforms and/or stretches seat 12, thereby causing a sag in seat 12. This sag in seat 12 produces a longitudinal force or tension on sensor assembly 20 and thus strap 24, and switch 40, since strap 24 is fixedly secured on either side of seat 12, such as to rails 14. This longitudinal tension overcomes the bias of biasing member 46, compressing biasing member 46 and urging plunger 44 in a direction that pushes conductor 50 toward contacts 48, until conductor 50 is in electrical contact with contacts 48, thus closing the switch. As shown in FIG. 4, plunger 44 moves a maximum distance of $\Delta X$, which is the distance necessary to place conductor 50 in contact with contacts 48.

If the sag on seat 12 is to be great, longitudinal tension on sensor assembly 20 exceeds the force necessary to produce contact between conductor 50 and contacts 48, and no additional movement of plunger 44 is permitted, as conductor 50 abuts contacts 48. If further expansion of sensor assembly 20 is not permitted, this tension could damage switch 40, and/or cause discomfort for or injury to the occupant of seat 12. As illustrated in FIG. 5, any additional tension is accommodated by stretching of elastic portion 30. Elastic portion 30 is permitted to stretch a distance $\Delta Y$ to accommodate this additional longitudinal tension, to prevent injury or discomfort to the occupant of seat 12 and/or damage to switch 40.

When a person arises from seat 12, and the sag is removed from seat 12, the force applied by biasing member 46 acts to return plunger 44 to the position shown in FIG. 3 in which conductor 50 is spaced from contacts 48, thereby producing an opening of switch 40, and elastic portion 30 retracts elastically to return strap 24 to its original length.

In another embodiment, an alternative switch 80 for use with sensor assembly 20 will now be described with particular reference to FIG. 6, in which like numbers are used for like parts in FIGS. 1-5, where applicable. Like switch 40, in switch 80, elastic portion 30 is connected to end 60 of plunger 44 and portion 25 is connected to end 70 of housing 42 (or vice versa), such as by connectors 62. The primary difference between switch 40 and switch 80 is that switch 80 is in a normally closed condition in the absence of a person seated in seat 12. Biasing member 46 urges plunger 44 to the left as shown in FIG. 6, or into a condition in which conductor 82 is in electrical contact with contacts 84 to provide a closed circuit. Contacts 84 may be positioned on lips 52 facing enlarged portion 64, or contacts 84 may be spaced axially away from lips 52 toward enlarged portion 64, but on a side of lips 52 facing end 60. In this embodiment, conductor 82 typically is disposed on the opposite side of enlarged portion 64 from conductor 50 and facing contacts 84 and lips 52 so that conductor 82 is urged into electrical contact with contacts 84 when biasing member 46 is in an extended position as shown in FIG. 6, or in which plunger 44 is disposed to the left with respect to housing 42 in FIG. 6. Conductor 82 may be similar to conductor 50, such as a ring disposed on and encircling the shaft of plunger 44. Contacts 84 are coupled to an external circuit (not shown) by wires 86.

Figure 6:
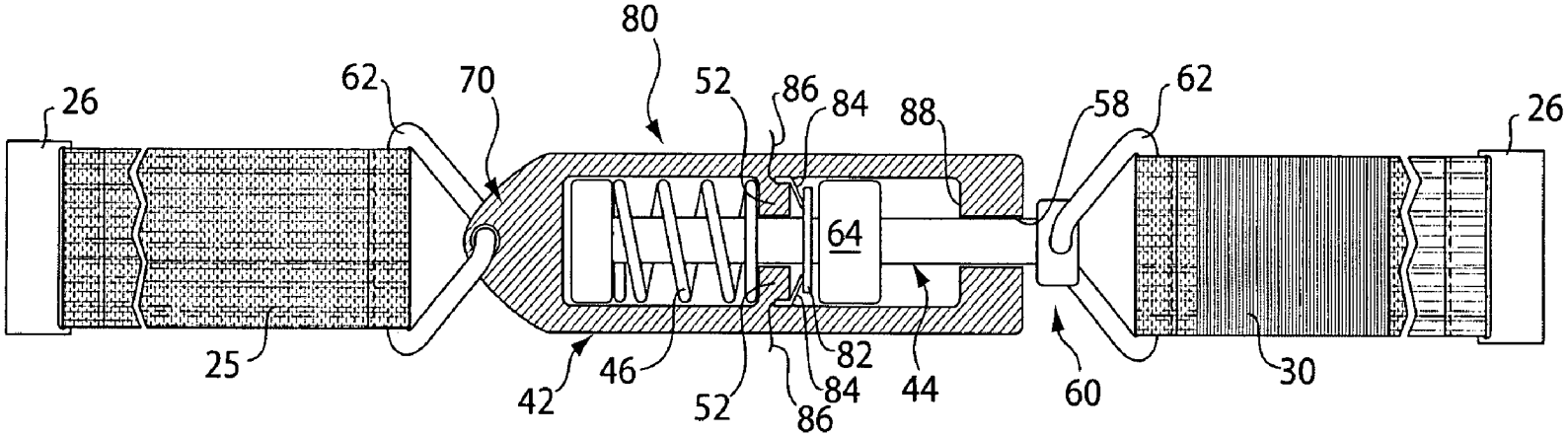
FIG. 6 is a partial, cross-sectional side view of another embodiment of the sensor of this invention having a switch in a closed position.
Figure 7:
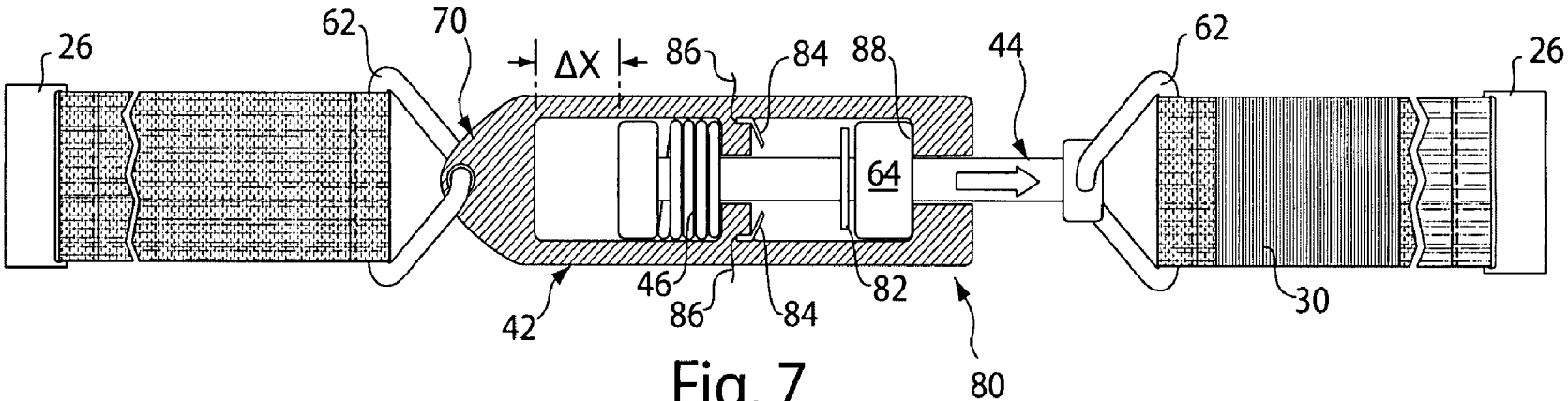
FIG. 7 is a partial, cross-sectional side view of the sensor of FIG. 6 showing a switch in an open position.

The operation of the embodiment of FIG. 6 will now be described with particular reference to FIGS. 6 and 7. As previously discussed with respect to FIGS. 1-5, when a person sits on seat 12, a longitudinal tension or force is applied to assembly 20 which urges plunger 44 axially toward the right with respect to housing 42, by compressing biasing member 46, as shown in FIG. 7. Such axial movement of plunger 44 separates conductor 82 from contacts 84 and opens the switch. Movement of plunger 44 in an axial direction with respect to housing 42, to the right, as shown in FIG. 6, is permitted to continue until enlarged portion 64 strikes shoulders 88 of housing 42. At this point, further axial movement of plunger 44 with respect to housing 42 is prevented. As discussed with respect to FIGS. 1-5, any further longitudinal tension applied to assembly 20 is accommodated by stretching of elastic portion 30. As a person arises from seat 12, biasing member 46 returns plunger 44 to the position shown in FIG. 6 in which contacts 84 are in electrical contact with conductor 82 to close the switch, and portion 30 contracts in the same manner as discussed with respect to switch 40.

Typically, the spring constant of biasing member 46 is lower than that of portion 30 to permit opening of switch 80 prior to any significant stretching of portion 30. Moreover, biasing member 46 of switch 80 may have a somewhat higher spring constant than that of biasing member 46 of switch 40 to prevent inadvertent opening of switch 80 in response to random forces applied to seat 12 that are not caused by a person sitting in the seat.

Figure 8:
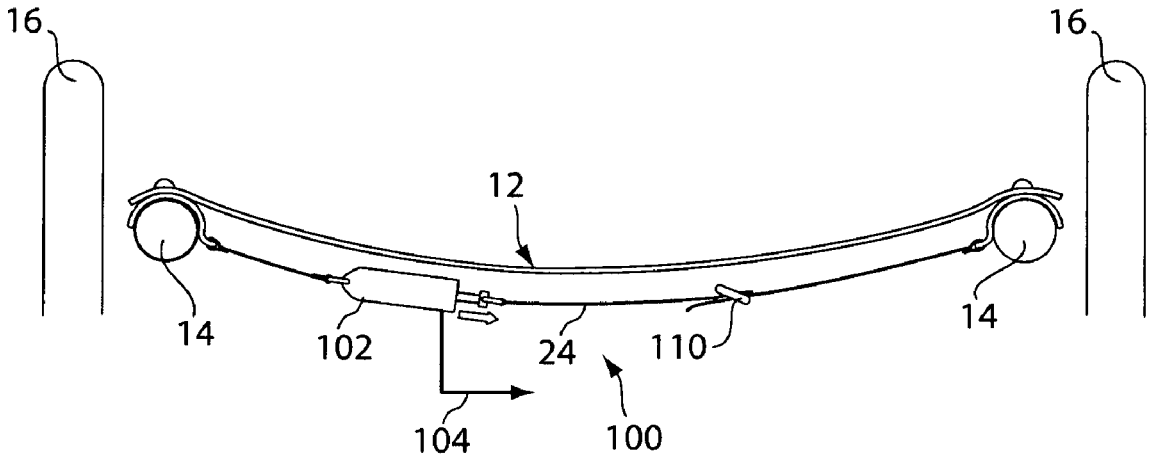
FIG. 8 is a partial side view of another embodiment of the invention.

Another embodiment of this invention will now be described with specific reference to FIG. 8. In FIG. 8, like numbers are used for like parts in FIGS. 1-5 where applicable. In FIG. 8, a strap 100 extends beneath seat 12 and is affixed at or near its ends, such as to rails 14. Strap 100 includes somewhere along its length a strain gauge 102, which measures the amount of stretch of strap 100. Typically, strap 100 is elastic, or includes an elastic portion, so that as a person sits on seat 12, strap 100, or a portion thereof, will stretch. Conversely, strap 100 contracts once a seated person leaves seat 12 to return strap 100 to its original length. The amount of stretch of strap 100 depends on the amount of flexibility and stretch of seat 12 and upon the sensitivity of strain gauge 102. As a person sits on seat 12 and applies a longitudinal stretching force or tension on strap 100, causing stretching of strap 100, or a portion thereof, strain gauge 102 measures the amount of stretch. Gauge 102 then sends a signal to a remote location via wires 104. Once the amount of stretch exceeds an amount indicative of a person seated in seat 12, a signal may be generated. Conversely, when the measured strain drops below that amount, a signal may be generated. Strain gauge 102 may be any commercially available gauge which senses elongation of a material.

In another aspect of each of the embodiments of FIGS. 1-8, an adjustment device 110 may be employed with sensor assembly 20 and/or strap 100 to adjust the length of assembly 20 and/or strap 100. The length of assembly 20 and/or strap 100 preferably should be adjusted so that the assembly 20 and/or strap 100 are relatively taut and are positioned adjacent the lower surface 13 of seat 12 so that the desired amount of stretching of seat 12 caused by a person sitting on seat 12 will be detected. However, assembly 20 and strap 100 should be not so taut as to cause a signal to be sent from switch 40 or 80 and strain gauge 102 caused by inadvertent forces applied to seat 12 and not by someone sitting on seat 12. This adjustment device 110 can also provide an adjustment of the tension on straps 24 and/or 100 to conform to the amount of stretch, flex and/or deformation permitted by seat 12 when one is seated in seat 12 which could vary with time and use of seat 12. Of course assembly 20 and strap 100 should not be so loose that when one sits on seat 12, no signal is provided by switch 40 or 80 and strain gauge 102. A typical example of an adjustment device 110 is a buckle. Other types of adjustment devices would include mating hook and loop fasteners, snaps, buttons or the like.

Figure 9:
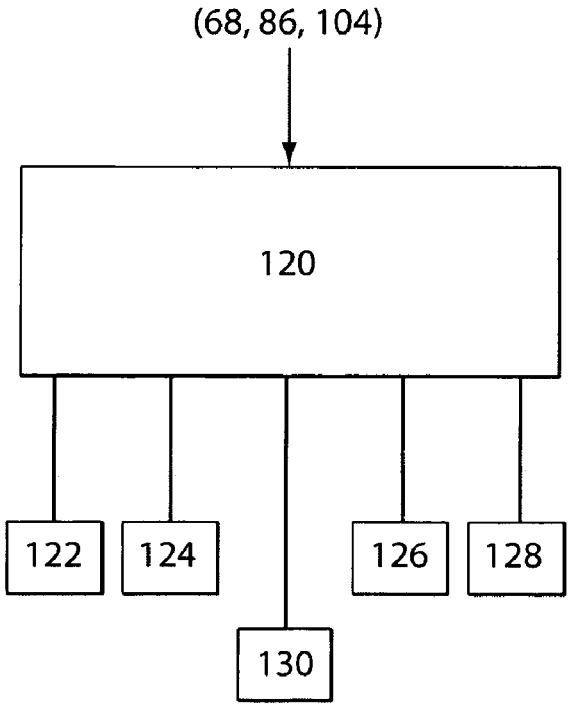
FIG. 9 is a schematic diagram illustrating a processor and associated systems for use with this invention.

For each of switch 40, switch 80 and strain gauge 102, the signal output therefrom (or lack thereof) over respective wires 68, 86 and 104 may be provided to a processor 120, as shown in FIG. 9. Processor 120 may be programmable, or may be hard wired and may be conventional. Processor 120 typically is coupled to one or more devices which could, for example, include an alarm 122, another audible device 124, such as a recorded call for help, an inaudible device, such as a light 126, a telephone jack 128 for sending a recorded message or a braking system 130 on a chair 10. It should be understood that any single one or more of these devices may be coupled to processor 120. Also, these devices may be directly coupled to the output wires 68, 86 and 104 of respective switches 40 and 80 and gauge 102, and not to processor 120. It is to be understood that with regard to the braking system 130, the action of being seated in the chair could cause either a release or activation of the brake, while the action of arising from the chair could cause either activation or release of the brake depending upon the desired result.

Alarm 122, device 124, light 126 and telephone jack 128 are commonly known in the art, and need not be described further. The braking systems also would be conventional, and could include a solenoid or mechanically actuated brake which either applies the brake or releases the brake. It is to be understood that any or all of these devices could be triggered either by someone being seated in the chair or by someone arising from chair 12.

The method of the present invention will now be described with reference to FIGS. 1-9. As noted, this invention is to be used with a support that is flexible and preferably stretches or sags. The support may be a seat such as one that is known as a sling-type seat. This invention involves detecting when a person is seated on, lying on, or arises from a flexible support, such as a seat, bed or support for a mattress. A sensor assembly 20 or strap 100 is positioned directly beneath a lower surface 13 of the support, such as seat 12. It is preferred that sensor assembly 20 or strap 100 be disposed closely adjacent lower surface 13 so that any flexing, deformation, sag and/or stretch will produce a corresponding tension in assembly 20 or strap 100. Assembly 20 and strap 100 are typically tightly attached to the frame on either side of the support. In the examples shown in FIG. 1, and in FIG. 8, respective straps 24 and 100 are affixed to rails 14. However, it is to be understood that straps 24 and 100 could be affixed to other portions of a frame and need not be affixed to rails 14. Once strap 24 or 100 has been affixed, typically at its ends (although not necessarily), and typically by an affixation device 26, typically assembly 20 or strap 100 is tensioned so as to conform relatively closely to the shape of lower surface 13 when no one is on the support. Also, assembly 20 or strap 100 may be approximately equally spaced from lower surface 13 generally along its length. This tension and conformity and spacing may be adjusted utilizing adjustment device 110.

Figure 5:
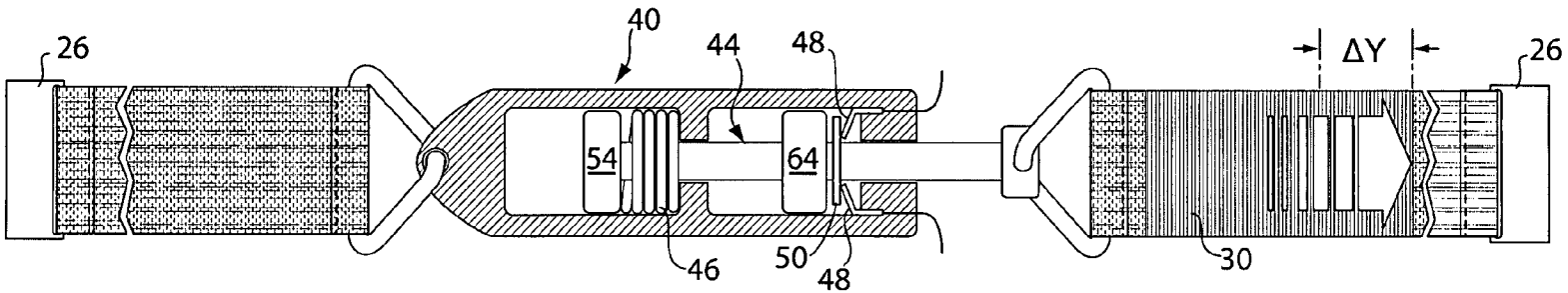
FIG. 5 is a partial, cross-sectional side view of the sensor assembly of FIG. 4 illustrating stretching of the strap.

In the embodiment of FIGS. 3-5, when a person is disposed on the support, the tension, or longitudinal force applied to assembly 20 initially produces longitudinal movement of plunger 44 with respect to housing 42 to the right as shown in FIG. 4 against the bias of biasing member 46. Because the spring constant of biasing member 46 is lower than that of elastic portion 30, movement of plunger 44 will occur prior to any substantial stretching of elastic portion 30. However, it is to be understood, that movement of plunger 44 may also be accompanied by some stretching of elastic portion 30. Once plunger 44 has moved with respect to housing 42 to the position shown in FIG. 5, conductor 50 is in electrical contact with contacts 48, thereby closing the switch. This closed switch causes a signal to be sent through wires 68, such as to processor 120. Processor 120 may do nothing or it may activate alarm 122, audible device 124, light 126, a connection to a telephone jack 120, or brake system 130 associated with a chair 10. Processor 120 may also activate more than one of the foregoing, depending on how it is wired or programmed. For example, processor 120 could release brake system 130 as well as activate alarm 122 and phone jack 128.

Further tension or longitudinal force applied to assembly 20 after engagement of conductor 50 by contacts 48 is accommodated by stretching of elastic portion 30. In this manner, the person disposed on the support typically is not caused any discomfort or injury.

When a person on the support arises, plunger 44 returns to the position shown in FIG. 3 and elastic portion 30 retracts to its original length. At this point, the switch is opened. This opening of the switch could also result in a signal sent such as to processor 120 and/or cause an alarm and/or an audible signal and/or an inaudible signal such as a light and/or connection to a telephone jack and/or release or activation of a brake on the chair.

With respect to the embodiment of FIGS. 6 and 7, when a person is disposed on the support, plunger 44 axially moves with respect to housing 42 from the position shown in FIG. 6 to that shown in FIG. 7. When this movement of plunger 44 occurs, the switch is opened. This opening of a switch may result in a signal sent, such as to processor 120 and may cause an alarm and/or an audible signal and/or an inaudible signal such as a light and/or connection to a telephone jack and/or activation or deactivation of a brake on a chair 10.

Movement of plunger 44 in FIG. 6 continues until it reaches the position shown in FIG. 7 in which enlarged portion 64 is in contact with shoulders 88. Thereafter, any additional longitudinal tension or force applied to assembly 20 is accommodated by stretching of elastic portion 30 as previously discussed.

When a person arises, plunger 44 returns to the position shown in FIG. 6 at which time the switch is closed, again sending a signal such as to processor 120 which could do nothing, or the signal could cause activation of an alarm and/or some other audible signal and/or an inaudible signal, such as a light and/or a connection to a telephone jack and/or a brake on the chair. In addition, as before, elastic portion 30 returns to its original, unstretched condition.

With respect to the embodiment of FIG. 8, when a person is disposed on the support, strap 100, at least a portion of which is elastic, stretches. After a certain predetermined amount of stretch, as measured by gauge 102, a signal is sent such as to processor 120 which can do nothing or can activate an alarm and/or some other audible signal and/or an inaudible signal, such as a light and/or a connection to a telephone jack and/or a brake on the chair. When a person arises in FIG. 8, the elastic strap 100 returns to its original, unstretched condition. Gauge 102 can either send a signal to processor 120, or interrupt the signal previously sent to processor 120. In either event, processor 120 can do nothing in response, or it may activate an alarm and/or some other audible signal and/or an inaudible signal such as a light and/or a connection to a telephone jack and/or a brake on a chair.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A method of determining whether a person is disposed on a support that flexes downwardly when a person is disposed thereon, said method comprising:

affixing an assembly beneath the support adjacent a lower surface thereof, wherein the assembly includes a sensor having a plunger;

adjusting a length of the assembly so that the assembly generally conforms to a shape of the lower surface of the support when no one is disposed on the support;

allowing the plunger to slide in a direction generally parallel to the lower surface of the support when tension is applied to the assembly; and providing an electrical signal from the sensor when the plunger slides a predetermined distance resulting from flexing of the support downwardly when a person is disposed thereon.

2. The method as recited in claim 1, further comprising the step of activating an alarm in response to the signal.

3. The method as recited in claim 1, further comprising the step of activating an alarm in the absence of the signal.

4. The method as recited in claim 1, further comprising sending the signal to a processor.

5. The method as recited in claim 1, further comprising activating a light in response to the signal or the absence of the signal.

6. The method as recited in claim 1, further comprising manipulating a brake associated with a seat in response to the signal.

7. The method as recited in claim 1, further comprising sending a signal over a telephone line in response to the signal received from the sensor.

8. The method as recited in claim 1, further comprising providing an elastic portion on the assembly; and stretching the elastic portion once the plunger slides the predetermined distance to accommodate further flexing of the support.

9. The method as recited in claim 1, further comprising providing another electrical signal from the sensor indicative of tension on the assembly below a certain amount.

10. The method as recited in claim 8, further comprising providing a biasing member configured to urge the plunger in a direction opposite the direction of sliding of the plunger when the support flexes downwardly.

11. The method as recited in claim 10, wherein a spring constant of the biasing member is lower than the spring constant of the elastic portion.

12. A method of determining whether a person is disposed on a support that flexes downwardly when a person is disposed thereon, said method comprising:

affixing an assembly beneath the support adjacent a lower surface thereof, wherein the assembly includes an elastic portion;

adjusting a length of the assembly so that the assembly generally conforms to a shape of the lower surface of the support when no one is disposed on the support;

providing an electrical signal from a sensor associated with the assembly indicative of when downward flexing of the support exceeds a predetermined amount; and stretching the elastic portion to accommodate downward flexing of the support beyond the predetermined amount.

13. The method as recited in claim 12, wherein the assembly includes a plunger, the method further comprising allowing the plunger to slide when the support flexes downwardly, and wherein the electrical signal is provided from the sensor when the plunger slides a predetermined distance.

14. The method as recited in claim 13, wherein the sliding of the plunger the predetermined distance occurs prior to any substantial stretching of the elastic portion.

15. The method as recited in claim 13, further comprising providing a biasing member configured to urge the plunger in a direction opposite the direction of sliding of the plunger when the support flexes downwardly.

16. The method as recited in claim 15, wherein a spring constant of the biasing member is lower than the spring constant of the elastic portion.

17. The method as recited in claim 16, wherein the direction of sliding of the plunger is in a direction generally parallel to the lower surface of the support.

* * * * *